US007008305B2

(12) United States Patent
Sekiya

(10) Patent No.: US 7,008,305 B2
(45) Date of Patent: Mar. 7, 2006

(54) WATER JET-PROCESSING MACHINE

(75) Inventor: Kazuma Sekiya, Tokyo (JP)

(73) Assignee: Disco Corporation, Tokyo (JP)

( * ) Notice: Subject to any disclaimer, the term of this patent is extended or adjusted under 35 U.S.C. 154(b) by 0 days.

(21) Appl. No.: 11/056,210

(22) Filed: Feb. 14, 2005

(65) Prior Publication Data

US 2005/0181713 A1 Aug. 18, 2005

(30) Foreign Application Priority Data

Feb. 17, 2004 (JP) ..... 2004-039246

(51) Int. Cl.
*B24C 3/00* (2006.01)

(52) U.S. Cl. ..... 451/90; 451/102

(58) Field of Classification Search ..... 451/38, 451/39, 75, 87, 90, 102
See application file for complete search history.

(56) References Cited

U.S. PATENT DOCUMENTS 4,848,042 A * 7/1989 Smith et al. ..... 451/78
5,323,562 A * 6/1994 Puschner ..... 451/89
5,716,264 A * 2/1998 Kimura et al. ..... 451/443
5,733,174 A * 3/1998 Bingham et al. ..... 451/39
6,103,049 A * 8/2000 Batdorf ..... 156/251
6,645,053 B1 * 11/2003 Kimura et al. ..... 451/56
6,887,125 B1 * 5/2005 Kurogouchi ..... 451/5
2003/0092364 A1 * 5/2003 Erickson et al. ..... 451/75

FOREIGN PATENT DOCUMENTS

JP 2002-205298 7/2002

* cited by examiner

*Primary Examiner*—Jacob K. Ackun, Jr.
(74) *Attorney, Agent, or Firm*—Smith, Gambrell & Russell, LLP

(57) ABSTRACT

A water jet-processing machine comprising a workpiece holding table for holding a workpiece, a nozzle for applying processing water to the workpiece held on the workpiece holding table, and a processing water supply means for supplying processing water containing abrasive grains to the nozzles, wherein the water jet-processing machine comprises a plurality of the nozzles and an interval adjusting means for adjusting an interval between adjacent nozzles.

2 Claims, 7 Drawing Sheets

WATER JET-PROCESSING MACHINE

FIELD OF THE INVENTION

The present invention relates to a water jet-processing machine for cutting a workpiece such as a semiconductor wafer by emitting a jet of high-pressure water to the workpiece.

DESCRIPTION OF THE PRIOR ART

In the production process of a semiconductor device, individual semiconductor chips are manufactured by forming a circuit such as IC, LSI or the like in a large number of areas arranged in a lattice pattern on the front surface of a substantially disk-like semiconductor wafer and then, dicing the semiconductor wafer into the areas having each a circuit formed thereon along predetermined cutting lines called "streets". The thus divided semiconductor chips are packaged, and widely used in electric appliances such as cellular phones, personal computers or the like.

Lighter and smaller electric appliances such as cellular phones, personal computers and the like are now in demand, and packaging technologies called "Chip Size Package (CSP)" that can reduce the size of a semiconductor chip package, have been developed. As one of the CSP technologies, a packaging technology called a "Quad Flat Non-lead Package (QFN)" has been implemented. In this packaging technology called QFN, a CSP substrate is formed by arranging a plurality of semiconductor chips in a matrix form on a metal plate such as a copperplate, on which a plurality of connection terminals corresponding to the connection terminals of the semiconductor chips are formed and streets for sectioning the semiconductor chips arranged in a lattice pattern are formed, and by integrating the metal plate with the semiconductor chips by a resin portion formed by molding a resin from the reverse surface side of the semiconductor chips. This CSP substrate is cut along the streets to be divided into individual chip size packages (CSP).

The above CSP substrate is generally cut with a precision cutting machine called "dicing machine". This dicing machine comprises a cutting blade having an annular abrasive grain layer and cuts the CSP substrate along the streets by moving this cutting blade relative to the CSP substrate along the streets of the CSP substrate while rotating the cutting blade, thereby dividing it into individual chip size packages (CSP). When the CSP substrate is cut with the cutting blade, however, a problem arises that burrs are formed on the connection terminals to cause a short circuit between adjacent connection terminals, thereby reducing the quality and reliability of a chip size package (CSP).

Further, when not only the CSP substrate but a workpiece such as a semiconductor wafer or the like is cut with the cutting blade, a problem also occurs that fine chippings are adhered onto the obverse surface of the workpiece with the result of contamination of the workpiece.

As a cutting technology for solving the above problems caused by cutting with the cutting blade, for example, JP-A 2002-205298 proposes a water jet cutting processing method for cutting a workpiece by emitting a jet of high-pressure water containing abrasive grains such as silica, garnet, diamond or the like from a nozzle to the workpiece held by a workpiece holding means.

Furthermore, in the above-mentioned water jet cutting processing, when a workpiece such as a CSP substrate having a plurality of adjoined blocks is cut with the above jet of water, cutting work must be carried out for each block separately and hence, satisfactory productivity cannot be always obtained.

SUMMARY OF THE INVENTION

It is an object of the present invention to provide a water jet-processing machine capable of cutting every block of a workpiece having a plurality of adjoining blocks simultaneously.

According to the present invention, the above object can be attained by a water jet-processing machine comprising a workpiece holding table for holding a workpiece, a nozzle for emitting a jet of processing water to the workpiece held on the workpiece holding table, and a processing water supply means for supplying processing water containing abrasive grains to the nozzles, wherein the water jet-processing machine comprises a plurality of the nozzles and an interval adjusting means for adjusting an interval between adjacent nozzles.

The above interval adjusting means comprises a guide rail extending in a predetermined direction, a plurality of nozzle attachment members that are slidably arranged on the guide rail and are fitted with the respective nozzles, and a moving means for moving the nozzle attachment members along the guide rail.

Since the water jet-processing machine of the present invention has a plurality of nozzles for emitting a jet of processing water, it can cut every block of a workpiece having a plurality of adjoining blocks simultaneously, thereby making it possible to improve productivity. Further, since the water jet-processing machine of the present invention comprises an interval adjusting means for adjusting an interval between adjacent nozzles, the machine can easily deal with a difference in size of the blocks, even when the blocks making up the workpiece differ in size.

DETAILED DESCRIPTION OF THE PREFERRED EMBODIMENTS

Preferred embodiments of a water jet-processing machine constituted according to the present invention will be described in detail hereinunder with reference to the accompanying drawings.

Figure 1:
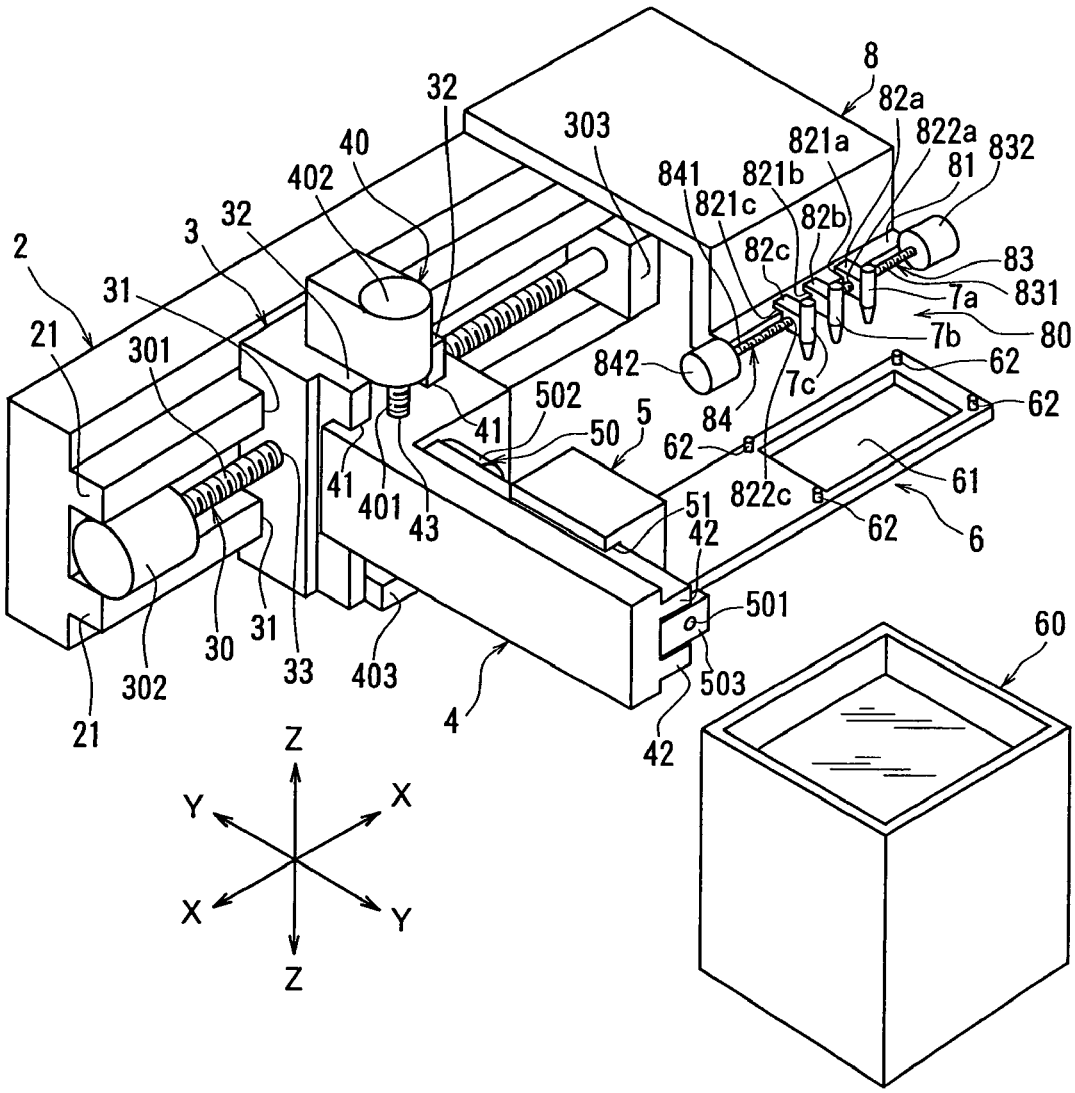
FIG. 1 is a perspective view of principal sections of a water jet-processing machine constituted according to the present invention.

FIG. 1 is a perspective view of the principal sections of a water jet-processing machine constituted according to the present invention. The water jet-processing machine shown in FIG. 1 comprises a stationary base 2, a first movable base 3, a second movable base 4 and a third movable base 5. A pair of guide rails 21 and 21 extending parallel to each other in the direction indicated by an arrow X are formed on the flank of the stationary base 2.

The first movable base 3 has a pair of to-be-guided grooves 31 and 31 that are formed on one flank opposed to the above stationary base 2 in the direction indicated by the arrow X and are slidably fitted to the pair of guide rails 21 and 21 provided on the stationary base 2, and a pair of guide rails 32 and 32 that are formed on the other flank and extend parallel to each other in the direction indicated by the arrow Z. By fitting the pair of the to-be-guided grooves 31 and 31 to the pair of guide rails 21 and 21, the thus constituted first movable base 3 is supported on the stationary base 2 in such a manner that it can move in the direction indicated by the arrow X. The water jet-processing machine in the illustrated embodiment comprises a first moving means 30 for moving the first movable base 3 along the pair of guide rails 21 and 21 provided on the above stationary base 2 in the direction indicated by the arrow X. The first moving means 30 has a male screw rod 301 arranged between the pair of guide rails 21 and 21 and in parallel thereto, and a pulse motor 302 for rotationally driving the male screw rod 301. The male screw rod 301 is screwed into a female screw 33 formed in the above first movable base 3, and one end thereof is rotatably supported on a bearing member 303 fixed to the stationary base 2. The drive shaft of the pulse motor 302 is connected to the other end of the male screw rod 301 so that the first movable base 3 is moved along the pair of guide rails 21 and 21 formed on the stationary base 2 in the direction indicated by the arrow X by rotating the male screw rod 301 in a normal direction or reverse direction.

The above second movable base 4 has a pair of to-be-guided grooves 41 and 41 that are formed on one flank opposed to the first movable base 3 in the direction indicated by the arrow Z and are slidably fitted to the pair of guide rails 32 and 32 provided on the first movable base 3, and a pair of guide rails 42 and 42 that are formed on a flank perpendicular to the above one flank and extend parallel to each other in the direction indicated by the arrow Y. By fitting the pair of to-be-guided grooves 41 and 41 to the pair of guide rails 32 and 32, the thus constituted second movable base 4 is supported on the first movable base 3 in such a manner that it can move in the direction indicated by the arrow Z. The water jet-processing machine in the illustrated embodiment comprises a second moving means 40 for moving the second movable base 4 along the pair of guide rails 32 and 32 provided on the first movable base 3 in the direction indicated by the arrow Z. The second moving means 40 has a male screw rod 401 arranged between the pair of guide rails 32 and 32 in parallel thereto, and a pulse motor 402 for rotationally driving the male screw rod 401. The male screw rod 401 is screwed into a female screw 43 formed in the second movable base 4, and one end thereof is rotatably supported on a bearing member 403 fixed to the first movable base 3. The drive shaft of the pulse motor 402 is connected to the other end of the male screw rod 401 so that the second movable base 4 is moved along the pair of guide rails 32 and 32 provided on the first movable base 3 in the direction indicated by the arrow Z by rotating the male screw rod 401 in a normal direction or reverse direction.

The above third movable base 5 has a pair of to-be-guided grooves 51 and 51 (only one upper groove is shown in FIG. 1) that are formed on one flank opposed to the above second movable base 4 in the direction indicated by the arrow Y and are slidably fitted to the pair of guide rails 42 and 42 provided on the above second movable base 4, and is supported on the second movable base 4 in such a manner that it can move in the direction indicated by the arrow Y by fitting the pair of to-be-guided grooves 51 and 51 to the pair of guide rails 42 and 42. The water jet-processing machine in the illustrated embodiment comprises a third moving means 50 for moving the third movable base 5 along the pair of guide rails 42 and 42 provided on the above second movable base 4 in the direction indicated by the arrow Y. The third moving means 50 has a male screw rod 501 arranged between the pair of guide rails 42 and 42 and in parallel thereto, and a pulse motor 502 for rotationally driving the male screw rod 501. The male screw rod 501 is screwed into a female screw (not shown) formed in the above third movable base 5, and one end thereof is rotatably supported on a bearing member 503 fixed to the second movable base 4. The drive shaft of the pulse motor 502 is connected to the other end of the male screw rod 501 so that the third movable base 5 is moved along the pair of guide rails 42 and 42 on the second movable base 4 in the direction indicated by the arrow Y by rotating the male screw rod 501 in a normal direction or reverse direction.

A workpiece holding table 6 extending in the direction indicated by the arrow X is mounted to the other flank of the above third movable base 5. A rectangular opening 61 is formed in the workpiece holding table 6, and four positioning pins 62 are so arranged to project from the top surface around the opening 61. The water jet-processing machine in the illustrated embodiment has a water tank 60 that is installed below the workpiece holding table 6 and stores water for buffering a jet of water, which will be described later.

A plurality (three in the illustrated embodiment) nozzles of 7*a*, 7*b* and 7*c*, each having a squirt hole with a diameter of about 200 $\mu$m, for emitting a jet of water to the workpiece held on the workpiece holding table 6 are arranged above the workpiece holding table 6. The three nozzles 7*a*, 7*b* and 7*c* are supported on a nozzle support member 8 fixed on the above stationary base 2 via an interval adjusting means 80. The interval adjusting means 80 comprises a guide rail 81 that is provided on the nozzle support member 8 and extends in the direction indicated by the arrow X, nozzle attachment members 82*a*, 82*b* and 82*c* that are slidably disposed on the guide rail 81 and are equipped with the above nozzles 7*a*, 7*b* and 7*c*, respectively, a first moving means 83 for moving the nozzle attachment member 82*a* along the guide rail 81, and a second moving means 84 for moving the nozzle attachment member 82*c* along the guide rail 81.

The above nozzle attachment members 82*a*, 82*b* and 82*c* have to-be-guided grooves 821*a*, 821*b* and 821*c* that are formed on the surface opposite to the nozzle attachment surface and are slidably fitted to the above guide rail 81, respectively. Therefore, they are supported in such a manner that they can slide along the guide rail 81 by fitting the guide grooves 821*a*, 821*b* and 821*c* to the guide rail 81. In the illustrated embodiment, the attachment member 82*b* that is disposed at the center and is fitted with the nozzle 7*b* is fixed at a predetermined position of the guide rail 81 by a suitable fixing means.

The above first moving means 83 has a male screw rod 831 arranged parallel to the above guide rail 81 and a pulse motor 832 for rotationally driving the male screw rod 831. The male screw rod 831 is screwed into a female screw 822*a* formed in the nozzle attachment member 82*a* having the above nozzle 7*a*, and one end thereof is rotatably supported on a bearing member 833 (see FIG. 2) fixed to the above guide rail 81. The drive shaft of the pulse motor 832 is connected to the other end of the male screw rod 831 so that the nozzle attachment member 82*a*, that is, the nozzle 7*a* is moved along the guide rail 81 in the direction indicated by the arrow X by rotating the male screw rod 831 in a normal direction or reverse direction. Like the first moving means 83, the second moving means 84 has a male screw rod 841 arranged parallel to the above guide rail 81 and a pulse motor 842 for rotationally driving the male screw rod 841. The male screw rod 841 is screwed into a female screw 822*a* formed in the nozzle attachment member 82*c* having the above nozzle 7*c*, and one end thereof is rotatably supported on a bearing member 843 (see FIG. 2) fixed to the above guide rail 81. The drive shaft of the pulse motor 842 is connected to the other end of the male screw rod 841 so that the nozzle attachment member 82*c*, that is, the nozzle 7*c* is moved along the guide rail 81 in the direction indicated by the arrow X by rotating the male screw rod 841 in a normal direction or reverse direction.

A description is subsequently given of a processing water supply means 9 for supplying processing water containing abrasive grains to the above nozzles 7*a*, 7*b* and 7*c* with reference to FIG. 2.

Figure 2:
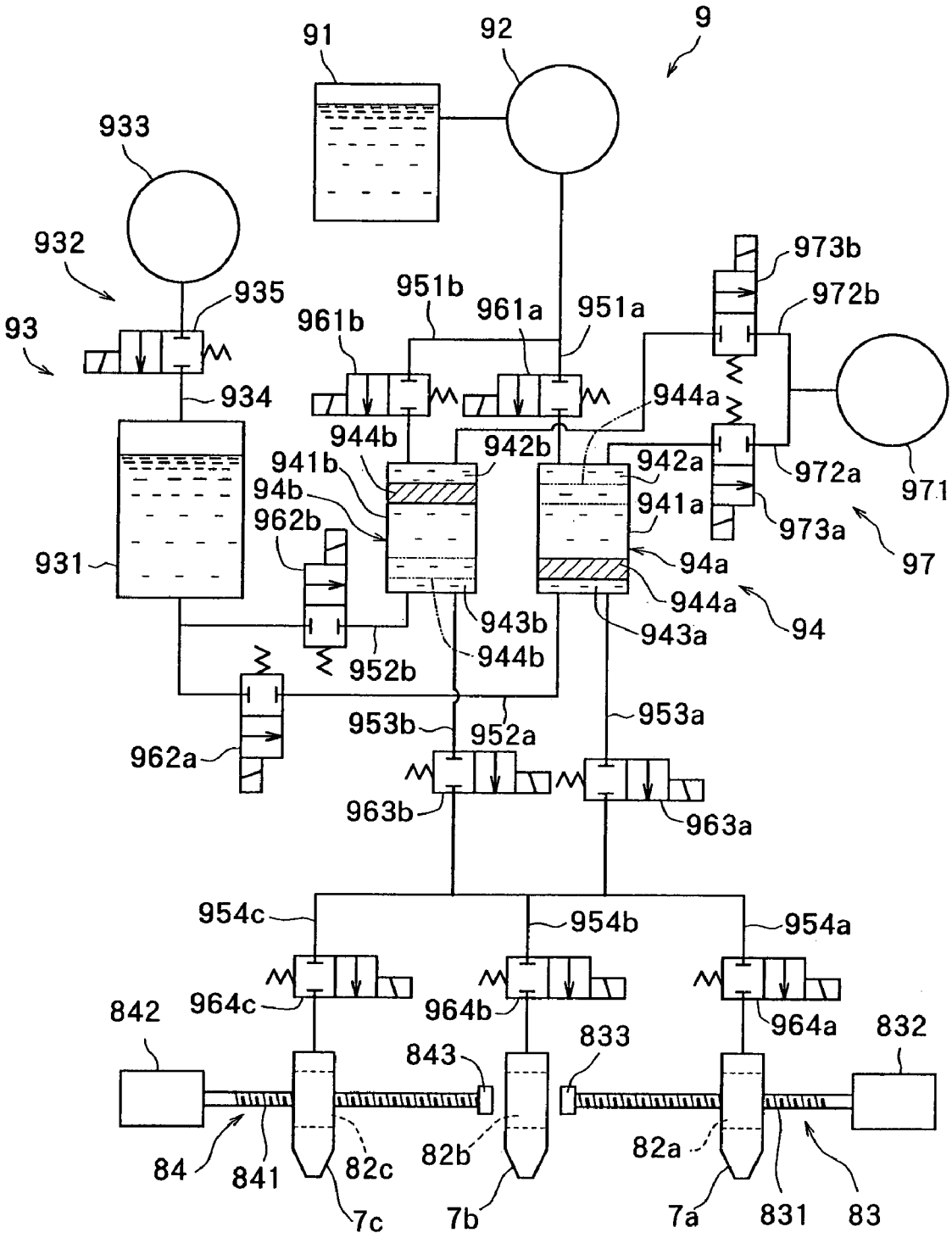
FIG. 2 is a fluid circuit diagram of a processing water supply means provided in the water jet-processing machine shown in FIG. 1.

The processing water supply means 9 shown in FIG. 2 comprises a water tank 91, a high-pressure water generating means 92, a processing water storage means 93 and a processing water delivery means 94. The water tank 91 holds fresh water such as tap water or pure water. The high-pressure water generating means 92 increases the pressure of water supplied from the water tank 91 to 50 to 100 MPa and supplies it to the processing water delivery means 94.

The above processing water storage means 93 comprises a processing water storage tank 931 and a pressure means 932 for pressurizing processing water stored in the processing water storage tank 931. The processing water storage tank 931 stores processing water that is a mixture of water and fine abrasive grains such as silica, garnet, diamond or the like. The pressure means 932 comprises an air pump 933, a pressure pipe 934 for communicating the air pump 933 with an air introduction port formed in the top wall of the above processing water storage tank 931, and an electromagnetic changeover valve 935 installed in the pressure pipe 934.

The above processing water delivery means 94 comprises a first processing water delivery means 94*a* and a second processing water delivery means 94*b* in the illustrated embodiment. The first processing water delivery means 94*a* comprises a first cylinder 941*a* and a first piston 944*a* that is slidably installed in the first cylinder 941*a* and partitions the inside space of the first cylinder 941*a* into a first chamber 942*a* and a second chamber 943*a*. Also, the second processing water delivery means 94*b* comprises a second cylinder 941*b* and a second piston 944*b* that is slidably installed in the second cylinder 941*b* and partitions the inside space of the second cylinder 941*b* into a first chamber 942*b* and a second chamber 943*b*. A diaphragm may be used, in place of the first piston 944*a* and the second piston 944*b*, to partition the inside space of the cylinder into a first chamber and a second chamber. That is, the piston or diaphragm for partitioning the inside space of the cylinder into the first chamber and the second chamber functions as a partition member, which partitions the inside space of the cylinder into the first chamber and the second chamber and can be displaced by the pressures of the both chambers.

The first chambers 942*a* and 942*b* of the first cylinder 941*a* and the second cylinder 941*b* constituting the first processing water delivery means 94*a* and the second processing water deliver means 94*b* are communicated with the above high-pressure generating means 92 via high-pressure pipes 951*a* and 951*b*, respectively. The high-pressure pipes 951*a* and 951*b* are provided with electromagnetic changeover valves 961*a* and 961*b*, respectively. The first chambers 942*a* and 942*b* of the first cylinder 941*a* and the second cylinder 941*b* are respectively communicated with a drainage means 97. This drainage means 97 comprises a vacuum pump 971 as a suction means, drainage pipes 972*a* and 972*b* for communicating the vacuum pump 971 with the above first chambers 942*a* and 942*b*, respectively, and electromagnetic changeover valves 973*a* and 973*b* installed in the drainage pipes 972*a* and 972*b*, respectively.

The second chambers 943*a* and 943*b* of the first cylinder 941*a* and the second cylinder 941*b* constituting the first processing water delivery means 94*a* and the second processing water delivery means 94*b* are communicated with the above processing water storage tank 931 via introduction pipes 952*a* and 952*b*, respectively. The introduction pipes 952*a* and 952*b* are provided with electromagnetic changeover valves 962*a* and 962*b*, respectively. The second chambers 943*a* and 943*b* of the first cylinder 941*a* and the second cylinder 941*b* are communicated with the above nozzles 7*a*, 7*b* and 7*c* via delivery pipes 953*a* and 953*b* and delivery pipes 954*a*, 954*b* and 954*c*. The delivery pipes 953*a* and 953*b* are provided with electromagnetic changeover valves 963*a* and 963*b*, respectively. The delivery pipes 954*a*, 954*b* and 954*c* are provided with electromagnetic changeover valves 964*a*, 964*b* and 964*c*, respectively.

The processing water supply means 9 shown in FIG. 2 is constituted as described above, and its function will be described hereinbelow.

At the start of the operation of the processing water supply means 9, the high-pressure water generating means 92, the vacuum pump 971 and the air pump 933 are activated, and all the electromagnetic changeover valves are in a state of "turn-off", as shown in FIG. 2. To activate the first processing water delivery means 94*a* from the state shown in FIG. 2, the electromagnetic changeover valve 973*a* of the drainage means 97 is turned on and the electromagnetic changeover valve 962*a* is also turned on. As a result, high-pressure water in the first chamber 942*a* of the first cylinder 941*a* is sucked into the vacuum pump 971 through the drainage pipe 972*a* and the electromagnetic changeover valve 973*a* and simultaneously, processing water in the processing water storage tank 931 is also introduced into the second chamber 943*a* of the first cylinder 941*a* through the introduction pipe 952*a* and the electromagnetic changeover valve 962*a*, thereby moving upward the first piston 944*a* in FIG. 2. When the first piston 944*a* is moved to an upper position shown by the two-dot chain line in FIG. 2, the above electromagnetic changeover valve 973*a* and the electromagnetic changeover valve 962*a* are turned off. Then, the electromagnetic changeover valve 963*a* is turned on and the electromagnetic changeover valve 961*a* is also turned on. Thereby, high-pressure water generated by the high-pressure water generating means 92 is introduced into the first chamber 942*a* of the first cylinder 941*a* through the high-pressure pipe 951*a* and the electromagnetic changeover valve 961*a* to press down the first piston 944*a* in FIG. 2. As a result, processing water in the second chamber 943*a* of the first cylinder 941*a* is introduced into the nozzles 7*a*, 7*b* and 7*c* through the deliver pipe 953*a*, the electromagnetic changeover valve 963*a*, the delivery pipes 954*a*, 954*b* and 954*c* and the electromagnetic changeover valves 964*a*, 964*b* and 964*c*, and is emitted as a jet of water. When the first piston 944*a* of the first cylinder 941*a* reaches a lower position shown by the solid line in FIG. 2, the electromagnetic changeover valve 961*a* is turned off and further, the electromagnetic changeover valve 963*a* is also turned off to return to the state shown in FIG. 2.

A description is subsequently given of the operation of the second processing water delivery means 94*b*.

The state shown in FIG. 2 is a state where the second piston 944*b* constituting the second processing water delivery means 94*b* is moved to an upper position shown by a solid line to introduce processing water into the second chamber 943*b* of the second cylinder 941*b*. When the electromagnetic changeover valve 963*b* is turned on and the electromagnetic changeover valve 961*b* is also turned on from this state, high-pressure water generated by the high-pressure water generating means 92 is introduced into the first chamber 942*b* of the second cylinder 941*b* through the high-pressure pipe 951*b* and the electromagnetic changeover valve 961*b* to press the piston 944*b* in FIG. 2. As a result, processing water in the second chamber 943*b* of the second cylinder 941*b* is introduced into the nozzles 7*a*, 7*b* and 7*c* through the delivery pipe 953*b*, the electromagnetic changeover valve 963*b*, the delivery pipes 954*a* 954*b* and 954*c* and the electromagnetic changeover valves 964*a*, 964*b* and 964*c*, and is emitted as a jet of water. When the piston 944*b* of the second cylinder 941*b* reaches a lower position shown by the two-dot chain line in FIG. 2, the electromagnetic changeover valve 961*b* is turned off and the electromagnetic changeover valve 963*b* is also turned off. When the electromagnetic changeover valve 973*b* is then turned on and the electromagnetic changeover valve 962*b* is also turned on, high-pressure water in the first chamber 942*b* of the second cylinder 941*b* is sucked into the vacuum pump 971 through the drainage pipe 972*b* and the electromagnetic changeover valve 973*b*, and processing water in the processing water storage tank 931 is introduced into the second chamber 943*b* of the second cylinder 941*b* through the introduction pipe 952*b* and the electromagnetic changeover valve 962*b* to move upward the piston 944*b* in FIG. 2 to return to the state shown in FIG. 2.

By activating the first processing water delivery means 94*a* and the second processing water delivery means 94*b* alternately, processing water can be ejected continuously from the nozzles 7*a*, 7*b* and 7*c*. During the operation of the first processing water delivery means 94*a* and the second processing water delivery means 94*b* for delivering processing water to the nozzles 7*a*, 7*b* and 7*c*, the pressure of the first chamber 942*a* is nearly the same as that of the second chamber 943*a* in the first cylinder 941*a* and the pressure of the first chamber 942*b* is nearly the same as that of the second chamber 943*b* in the second cylinder 941*b*. Therefore, there is no difference in pressure between the first chamber 942*a* and the second chamber 943*a* of the first cylinder 941*a* and between the first chamber 942*b* and the second chamber 943*b* of the second cylinder 941*b* and hence, processing water in the second chamber 943*a* and the second chamber 943*b* does not enter on the sides of the first chamber 942*a* and the first chamber 942*b*, respectively. Therefore, the abrasion of the cylinder walls of the first cylinder 941*a* and the second cylinder 941*b* and the abrasion of the first piston 944*a* and the second piston 944*b* by the abrasive grains contained in the processing water is suppressed.

In the illustrated embodiment, the drainage means 97 is provided with the vacuum pump 971 as a suction means and the pressure means 932 for pressurizing processing water held in the processing water storage tank 931 is provided. However, either one of the vacuum pump 971 and the pressure means 932 may be suffice. For example, in the case where the vacuum pump 971 is provided and the pressure means 932 is omitted, the processing water storage tank 931 is made open to the air. In this case, the electromagnetic changeover valves 962*a* and 962*b* installed in the introduction pipes 952*a* and 952*b* for communicating the processing water storage tank 931 with the second chamber 943*a* of the first cylinder 941*a* and the second chamber 943*b* of the second cylinder 941*b* may be check valves which permit circulation of processing water from the processing water storage tank 931 side to the first cylinder 941*a* side and to the second cylinder 941*b* side but cut off circulation of processing water in the reverse direction. On the other hand, when the pressure means 932 is provided and the vacuum pump 971 is omitted, the drainage pipes 972*a* and 972*b* are made open to the air.

The CSP substrate as a workpiece to be cut by the above water jet-processing machine will be described with reference to FIG. 3.

Figure 3:
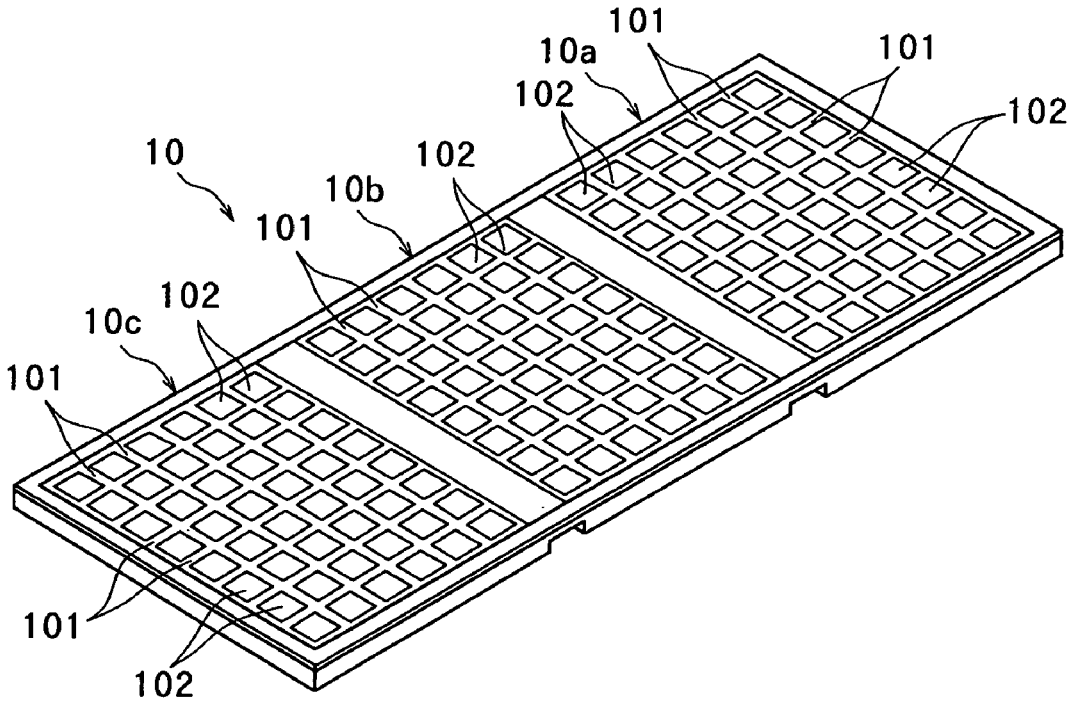
FIG. 3 is a perspective view of a CSP substrate as a workpiece.

The CSP substrate 10 shown in FIG. 3 is divided into three adjoining blocks 10*a*, 10*b* and 10*c*. A plurality of streets 101 are formed in a lattice pattern in each of the three blocks 10*a*, 10*b* and 10*c* constituting the CSP substrate 10, and a chip size package (CSP) 102 is arranged in each of a plurality of areas sectioned by the streets 101. The CSP substrate 10 thus formed is cut along the streets 101 to be divided into individual chip size packages (CSP).

Figure 4:
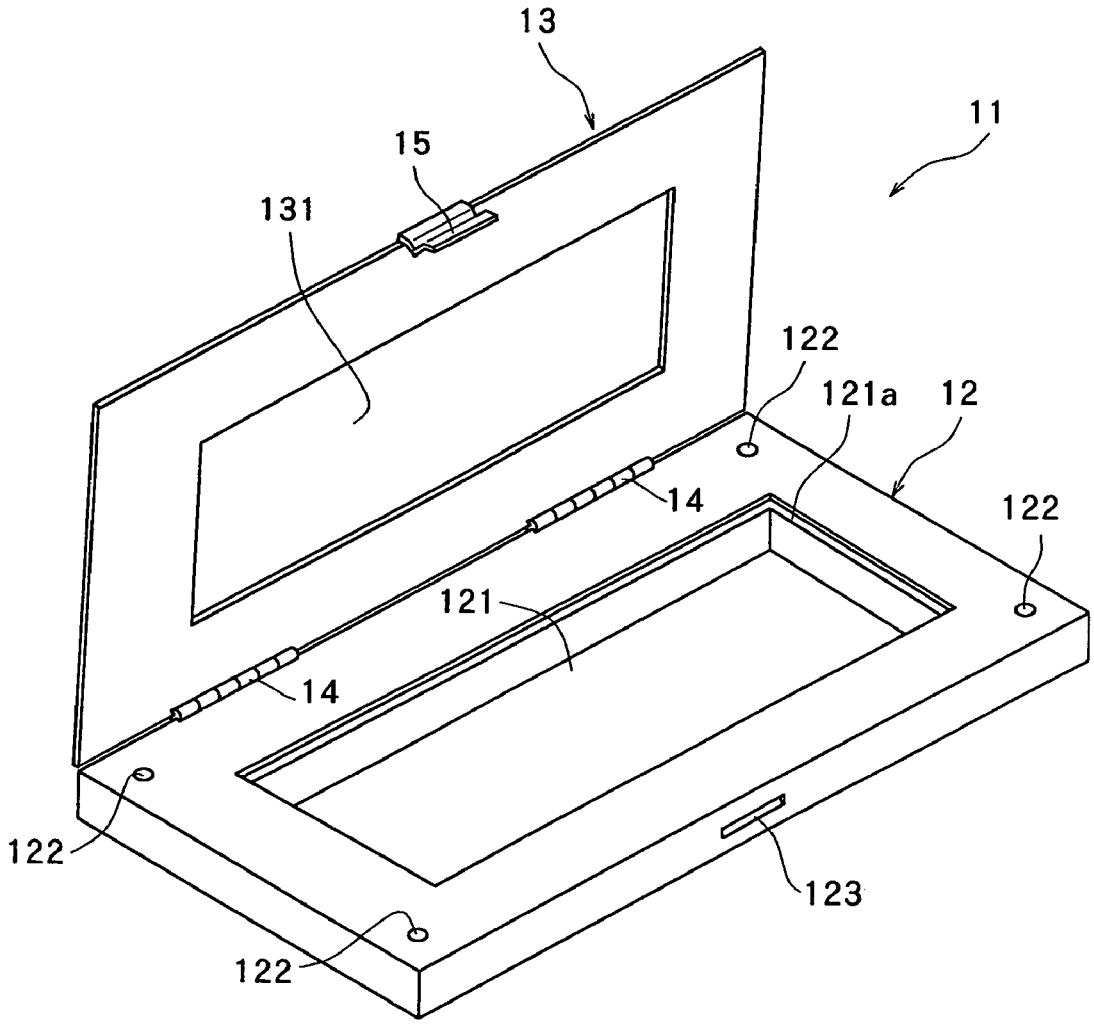
FIG. 4 is a perspective view of a workpiece holding jig for holding the CSP substrate as a workpiece and placing it on the workpiece holding table of the water jet-processing machine.

The above CSP substrate 10 is held by a workpiece holding jig 11 shown in FIG. 4 and then, held on the above workpiece holding table 6 of the water jet-processing machine. The workpiece holding jig 11 shown in FIG. 4 consists of a lower holding plate 12 and an upper holding plate 13, one sides of which are joined to each other by two hinges 14 and 14. The lower holding plate 12 and the upper holding plate 13 have openings 121 and 131, respectively. The openings 121 and 131 are similar in shape to the CSP substrate 10 but a little smaller than the CSP substrate 10. A stepped portion 121*a* having a thickness corresponding to that of the above CSP substrate 10 from the upper surface of the lower holding plate 12 is formed around the opening 121 of the lower holding plate 12. Four pin holes 122 to be fitted to four positioning pins 62 installed on the above workpiece holding table 6 are formed on both sides of the opening 121 in the lower holding plate 12. An engaging piece 15 is provided on the other side of the upper holding plate 13 and an engaging hollow 123 to be engaged with the above engaging piece 13 is formed on the other side of the lower holding plate 12.

To cut the above CSP substrate 10 along the streets 101, the CSP substrate 10 is first placed on the above stepped portion 121*a* formed in the lower holding plate 12 of the workpiece holding jig 11, the upper holding plate 13 is put on the lower holding plate 12, and the engaging piece 15 is engaged with the engaging, hollow 123. The workpiece thus holding jig 11 holding the CSP substrate 10 interposed between the lower holding plate 12 and the upper holding plate 13 is placed on the above workpiece holding table 6 of the water jet-processing machine shown in FIG. 1. At this point, by fitting the four pin holes 122 formed in the lower holding plate 12 to the four positioning pins 62 arranged on the workpiece holding table 6, the workpiece holding jig 11 holding the CSP substrate 10 is held at a predetermined position of the workpiece holding table 6.

Figure 5:
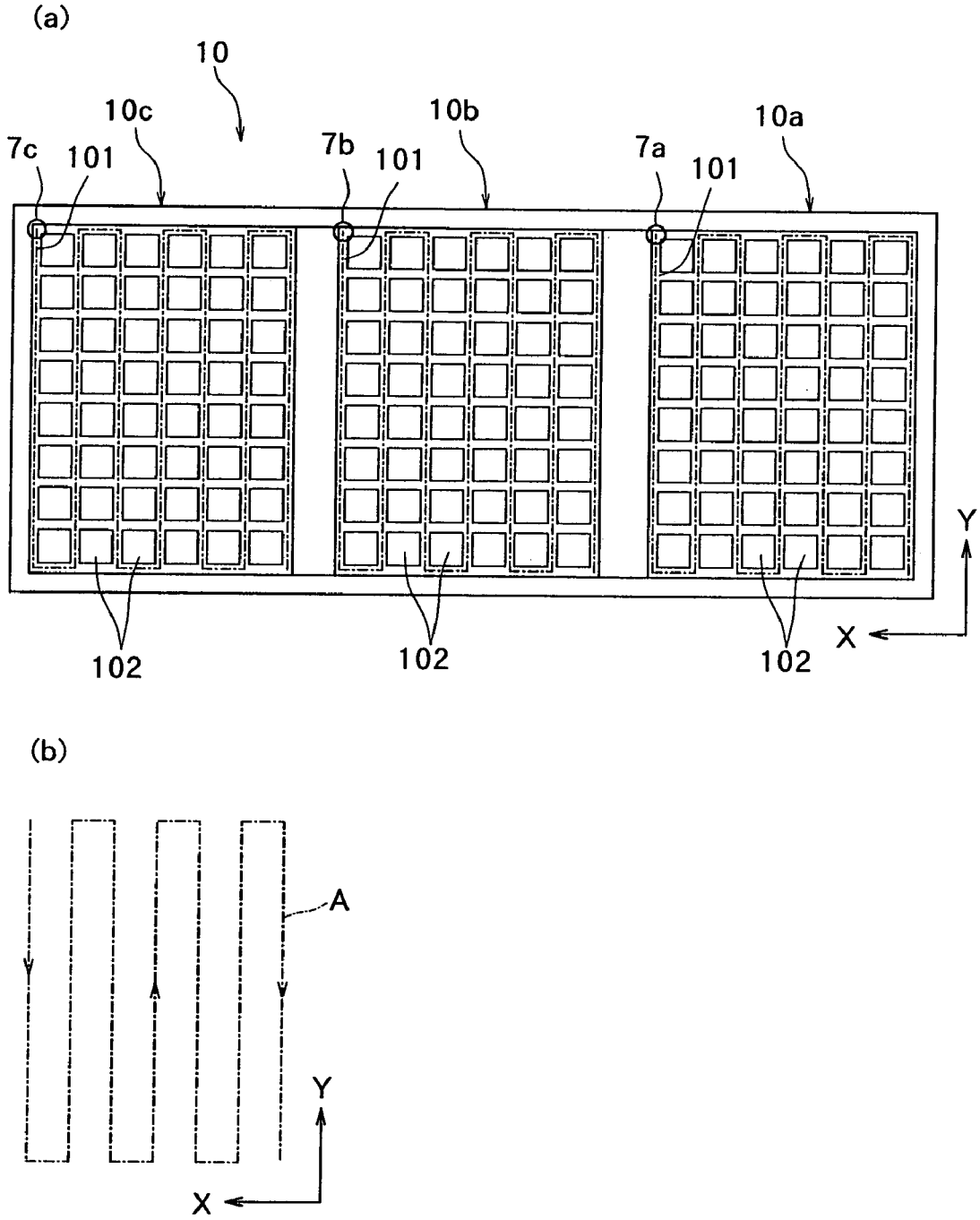
FIGS. 5(*a*) and 5(*b*) are diagrams for explaining a first cutting step for cutting the CSP substrate as a workpiece by the water jet-processing machine shown in FIG. 1.

After the workpiece holding jig 11 holding the CSP substrate 10 is held at the predetermined position of the workpiece holding table 6 of the water jet-processing machine, the first moving means 30 and the third moving means 50 are activated to move the first movable base 3 and the third movable base 5 in the directions indicated by the arrow X and the arrow Y, respectively, in order to move the CSP substrate 10 held on the workpiece holding table 6 to a processing area located below the three nozzles 7*a*, 7*b* and 7*c*. Then, the three nozzles 7*a*, 7*b* and 7*c* are respectively aligned with the streets 101 at the left ends in the drawing of the three blocks 10*a*, 10*b* and 10*c* forming the CSP substrate, as shown in FIG. 5(*a*). This positioning work is first carried out by aligning the center nozzle 7*b* with the street 101 at the left end of the center block 10*b*, then activating the first moving means 83 and the second moving means 84 to adjust the interval between the nozzle 7*b* and the nozzle 7*a* and the interval between the nozzle 7*b* and the nozzle 7*c* so as to align the nozzle 7*a* and the nozzle 7*c* with the streets 101 at the left ends of the blocks 10*a* and 10*c*, respectively. Then, the second moving means 40 is activated to move the second movable base 4 in the direction indicated by the arrow Z so as to bring the three nozzles 7*a*, 7*b* and 7*c* to predetermined positions with a predetermined interval (for example, 50 $\mu$m) above from the surface of the CSP substrate 10.

Thereafter, the processing water supply means 9 is activated as described above to emit a jet of processing water containing abrasive grains from the nozzles 7*a*, 7*b* and 7*c*, and the third moving means 50 and the first moving means 30 are activated to move the third movable base 5 and the first movable base 3 in the directions indicated by the arrow Y and the arrow X sequentially so that the workpiece holding table 6, that is, the CSP substrate 10 is moved along the streets 101 relative to the nozzles 7*a*, 7*b* and 7*c* as shown by the one-dot chain line in FIG. 5(*a*), that is, the CSP substrate 10 and the nozzles 7*a*, 7*b* and 7*c* are moved relative to each other in the directions indicated by the arrow Y and the arrow X sequentially as indicated by the arrow A in FIG. 5(*b*). This movement is carried out by a control means (not shown), which controls the above third moving means 50 and the first moving means 30 based on data on the interval between streets 101 and the length of the streets stored in the memory of the control means. As a result, the three blocks 10*a*, 10*b* and 10*c* of the CSP substrate 10 are cut along the streets 101 as shown by the one-dot chain line in FIG. 5(*a*) (first cutting step). At the time of this cutting, a jet of water penetrates the CSP substrate 10 but the power of a jet of water after cutting is weakened by buffer water held in the water tank 60.

Figure 6:
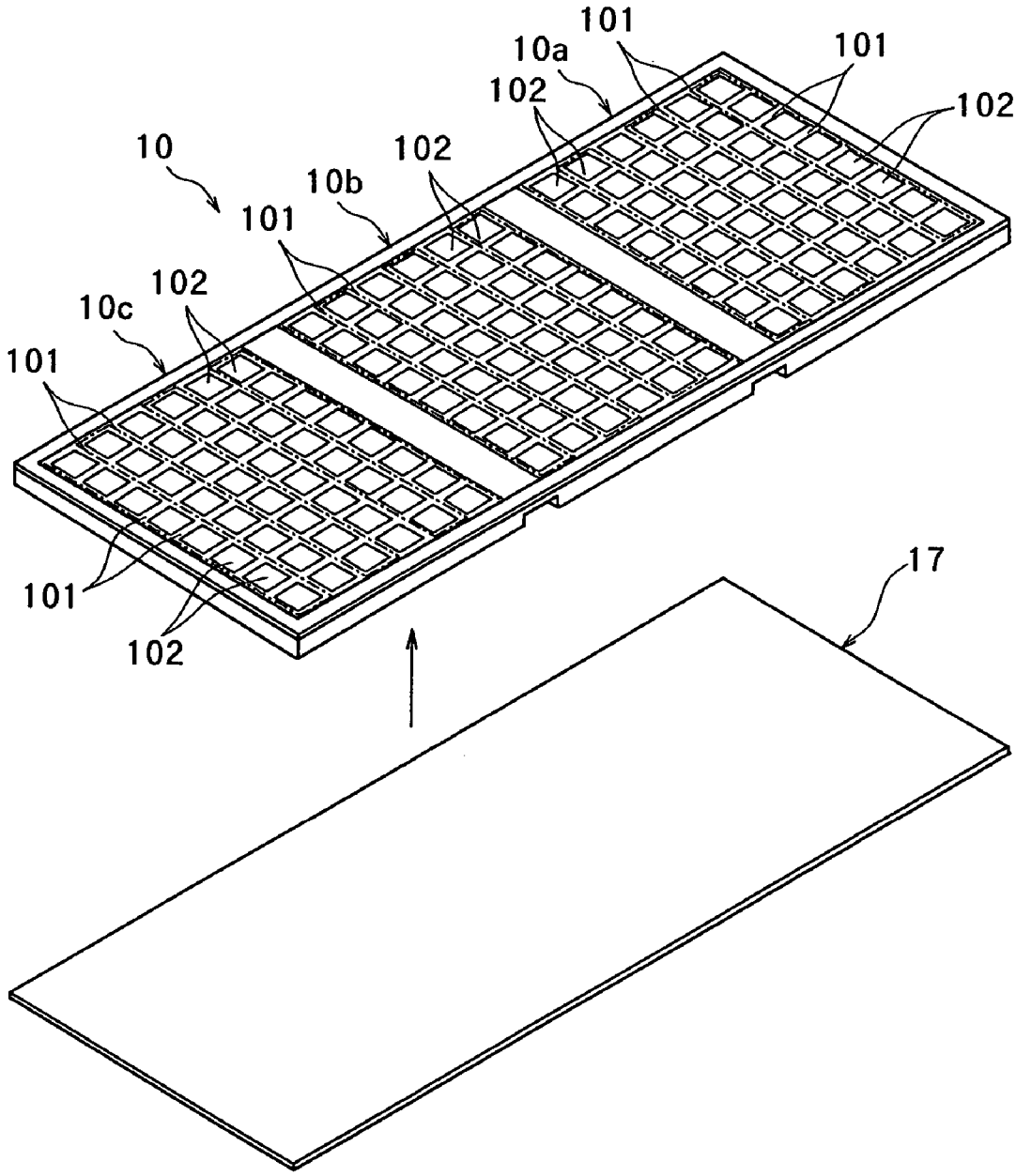
FIG. 6 is a diagram showing a state where a synthetic resin sheet is affixed to the back surface of the CSP substrate subjected to the first cutting step.

After the CSP substrate 10 is cut as shown by the one-dot chain line in FIG. 5(*a*), it is taken out from the workpiece holding jig 11, and a protective sheet 17 such as a synthetic resin sheet made of polyethylene terephthalate is affixed to the back surface of the CSP substrate 10 as shown in FIG. 6. The CSP substrate 10 having the protective sheet 17 thus affixed to the back surface is held by the workpiece holding jig 11 again. The workpiece holding jig 11 holding the CSP substrate 10 is held at the predetermined position of the workpiece holding table 6 of the water jet-processing machine again.

Figure 7:
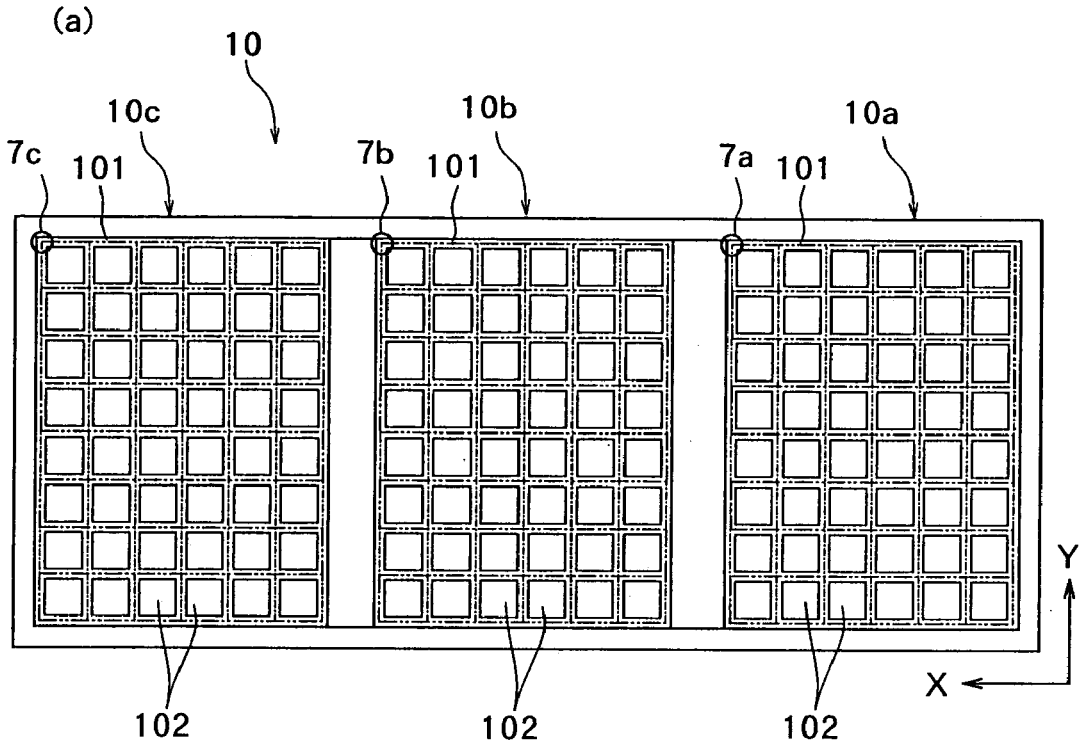
FIGS. 7(*a*) and 7(*b*) are diagrams for explaining a second cutting step for cutting the CSP substrate shown in FIG. 3 by the water jet-processing machine shown in FIG. 1.
Figure 7:
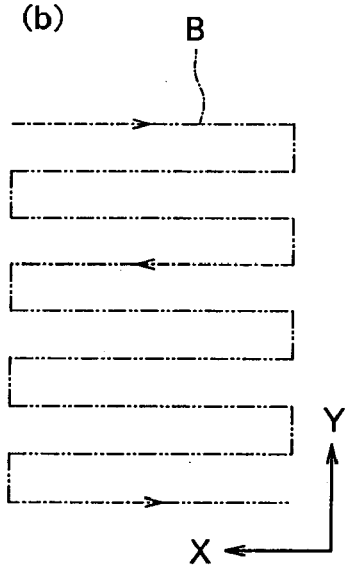

Thereafter, the first moving means 30 and the third moving means 50 are activated to move the first movable base 3 and the third movable base 5 in the directions indicated by the arrow X and the arrow Y so as to bring the streets 101 at the left ends in the drawing of the three blocks 10*a*, 10*b* and 10*c* of the CSP substrate 10 at positions right below the nozzles 7*a*, 7*b* and 7*c*, as shown in FIG. 7(*a*), respectively. The processing water supply means 9 is then activated, as described above, to emit a jet of processing water containing abrasive grains from the nozzles 7*a*, 7*b* and 7*c*, and the first moving means 30 and the third moving means 50 are activated to move the first movable base 3 and the third movable base 5 in the directions indicated by the arrow X and the arrow Y sequentially so that the workpiece holding table 6, that is, the CSP substrate 10 is moved along the streets 101 relative to the nozzles 7*a*, 7*b* and 7*c* as shown by the two-dot chain line in FIG. 7(*a*), that is, the CSP substrate 10 and the nozzles 7*a*, 7*b* and 7*c* are moved relative to each other in the directions indicated by the arrow X and the arrow Y sequentially as indicated by the arrow B in FIG. 7(*b*). As a result, the three blocks 10*a*, 10*b* and 10*c* of the CSP substrate 10 are cut along the streets 101 as shown by the two-dot chain line in FIG. 7(*a*) (second cutting step).

As described above, the three blocks 10*a*, 10*b* and 10*c* of the CSP substrate 10 are cut along the streets 101 as shown by the one-dot chain line and the two-dot chain line in FIG. 5(*a*) and FIG. 7(*a*) to be divided into individual chip size packages (CSP) 102. When the three blocks 10*a*, 10*b* and 10*c* of the CSP substrate 10 are cut as shown by the two-dot chain line, the protective sheet 17 affixed to the back surface of the CSP substrate 10 is also cut but portions shown by the one-dot chain line of the protective sheet 17 are not cut and hence, the protective tape 17 is not divided. Consequently, the CSP substrate 10 which has been divided into individual chip size packages (CSP) 102 maintains the state of the substrate by the protective sheet 17.

Since the water jet-processing machine in the illustrated embodiment has three nozzles 7*a*, 7*b* and 7*c* for emitting a jet of processing water, the three blocks 10*a*, 10*b* and 10*c* of the CSP substrate 10 can be cut simultaneously, thereby making it possible to improve productivity. When the CSP substrate is formed from two blocks, the above electromagnetic changeover valve 964*a* or 964*c* is turned off, and the nozzle 7*b* and the nozzle 7*a* or 7*c* are used. Since the water jet-processing machine in the illustrated embodiment comprises the interval adjusting means 80 for adjusting the interval between the nozzles 7*b* and 7*a* and the interval between the nozzles 7*b* and 7*c*, even when the blocks making up the CSP substrate differ in size, they can easily deal with a difference in size of the blocks.

What is claimed is:

1. A water jet-processing machine comprising a workpiece holding table for holding a workpiece, a nozzle for emitting a jet of processing water to the workpiece held on the workpiece holding table, and a processing water supply means for supplying processing water containing abrasive grains to the nozzle, wherein the water jet-processing machine comprises a plurality of the nozzles and an interval adjusting means for adjusting an interval between adjacent nozzles.

2. The water jet-processing machine according to claim 1, wherein the interval adjusting means comprises a guide rail extending in a predetermined direction, a plurality of nozzle attachment members that are slidably arranged on the guide rail and are fitted with the respective nozzles, and a moving means for moving the nozzle attachment members along the guide rail.

* * * * *